United States Patent [19]

Reiter

[11] 4,341,158

[45] Jul. 27, 1982

[54] APPARATUS FOR ELIMINATING POWER SOURCE RISE TIME EFFECTS IN A TIME FUZE SYSTEM

[75] Inventor: Alan C. Reiter, Rockville, Md.

[73] Assignee: The United States of America as represented by the Secretary of the Army, Washington, D.C.

[21] Appl. No.: 169,004

[22] Filed: Jul. 15, 1980

[51] Int. Cl.[3] ..... F42C 11/06

[52] U.S. Cl. ..... 102/215; 102/207

[58] Field of Search ..... 102/215, 207, 206

[56] References Cited

U.S. PATENT DOCUMENTS

| | | | |
|---|---|---|---|
| 3,646,371 | 2/1972 | Flad | 102/215 |
| 3,670,652 | 6/1972 | Ziemba | 102/215 |
| 3,760,732 | 9/1973 | Schuster et al. | 102/215 |
| 3,952,661 | 4/1976 | Vrataric, Jr. et al. | 102/215 |

*Primary Examiner*—Charles T. Jordan

*Attorney, Agent, or Firm*—Nathan Edelberg; Robert P. Gibson; Saul Elbaum

[57] ABSTRACT

A timing system for providing a fuze function time for firing a fuze which is independent of power source rise time. A non-volatile counter is programmed with a count indictative of the function time, and is read out starting at missile take-off to fire the fuze upon completion of read out of the count. Inhibit circuitry is provided for automatically reducing the stored count during the setting operation and for subsequently inhibiting the reading out of the counter by a time corresponding to the reduction in the stored count. This time is selected to be greater than the largest expectable rise time of the fluidic generator power source, but no longer than is necessary.

3 Claims, 4 Drawing Figures

APPARATUS FOR ELIMINATING POWER SOURCE RISE TIME EFFECTS IN A TIME FUZE SYSTEM

The invention described herein may be manufactured, used, and licensed by or for the United States Government for governmental purposes without the payment to me of any royalty thereon.

The present invention is directed to a timing system for a fuze which is independent of power source rise time.

As can be appreciated, an electronic time fuze for a weapon must be as accurate as possible to ensure that the weapon is detonated at the proper time. Presently, the systems of concern to the present invention are not as accurate as desired because of the variability of the power source rise time.

That is, the electronic components of the fuze do not begin to properly operate until the power source voltage or current reaches some threshold operating value, and the time from missile take off or some other reference time to the time that the threshold value is reached is known as the rise time. Unfortunately, the rise time does not remain constant, but varies with the circumstances, and this may be especially true when the power source is a fluidic generator which is located aboard the missile.

In such systems, an electronic timing means is programmed or set with a selected detonation time for producing a fuze trigger signal. However, since the timing means is powered by the power source, the programmed time will not begin to be read out of the timing means until after the rise time has elapsed. A variable rise time may thus introduce significant system error.

It is therefore an object of the invention to provide a more accurate electronic fuze timing system.

It is a further object of the invention to provide an electronic fuze timing system which is independent of power source rise time.

In accordance with the present invention, the above objects are accomplished by automatically reducing the selected time which is programmed in the timing means by a certain fixed time which is greater than the largest expectable rise time, and subsequently inhibiting the effective reading out of the timing means by the same fixed time.

The invention will be better understood by referring to the accompanying drawings, in which.

Figure 1:
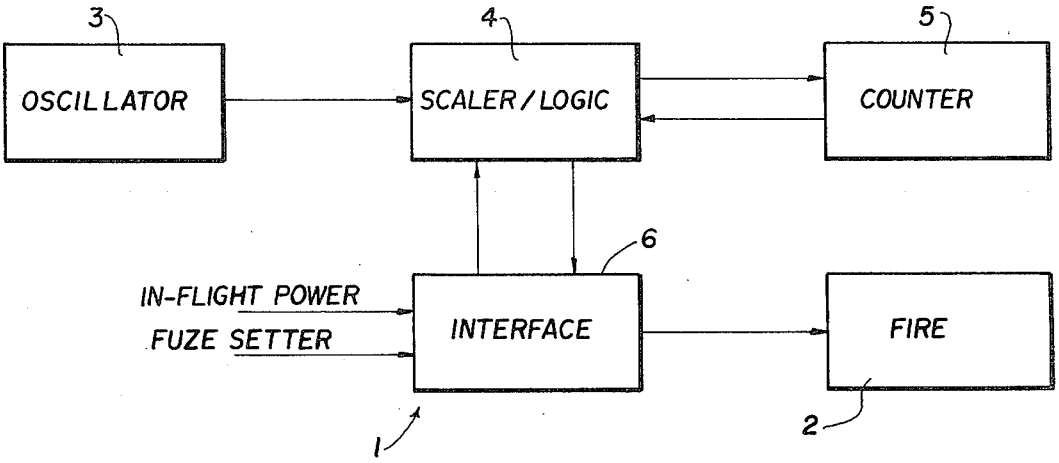
FIG. 1 PRIOR ART
FIG. 1 is a block diagram of a conventional fuze electronics system for providing a fuze trigger signal.

Referring to FIG. 1, a conventional electronics system for providing a fuze trigger signal is shown. The system is comprised of oscillator 3, scaler-logic circuitry 4, counter/non-volatile memory 5, and interface circuit 6.

To operate the system, the programmable timing means 5 is set with a selected value indictative of the fuze function time. The counter is set with pulses produced by oscillator 3 which are fed through scaler 4 to the counter. The fuze setter input line to interface 6 provides the power for operating the system during setting and also controls the programming and correspondingly, the number which is stored in counter 5.

When the missile in which the fuze is located takes off, in-flight power is provided to the system on the in-flight power input line to interface 6. This is operative to power the system to cause oscillator 3 to read the programmed or stored number out of counter 5. When the number is completely read out, a fuze fire signal is generated as shown at block 2 in the Figure. Since the counter is loaded on the ground before take-off, and it is desirable to load the counter as quickly as possible, scaler/logic circuitry 4 is arranged to load the counter at a quicker rate than the rate at which the counter is read out in-flight to provide the fuze function time.

As mentioned above, one problem which is encountered with the conventional system shown in FIG. 1 is that the variability of the in-flight power rise time leads to errors in the resulting fuze function time which is provided by the system. That is, the in-flight power is provided by a fluidic generator, which may take in excess of 100 milliseconds to rise to the point where it provides suitable power for the system. Since the rise time varies from one situation to the next, the constancy of the fuze function time provided by the system is adversely affected.

Figure 2:
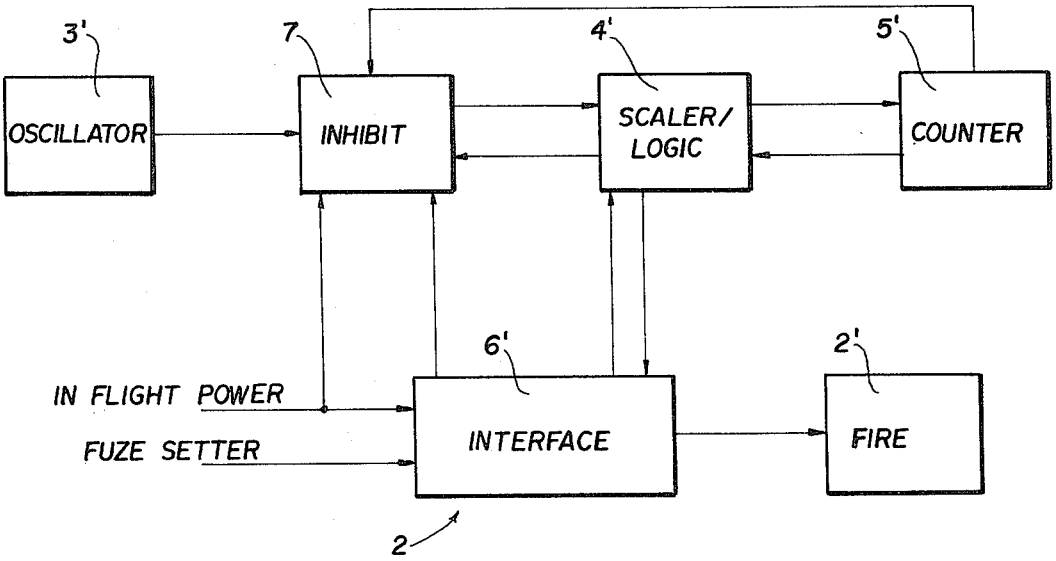
FIG. 2 is a block diagram of the present invention.

FIG. 2, in which blocks corresponding to those in FIG. 1 are denoted with corresponding reference numerals, is a block diagram of the present invention. It will be noted that the blocks of the system are identical to those of FIG. 1, except that inhibit block 7 has been added. In accordance with the invention, the inhibit block is arranged to inhibit a certain number of pulses from oscillator 3' from reaching counter 5', thus reducing the count stored during the setting operation. After the missile in which the fuze is located has taken off, inhibit block 7 is arranged to inhibit the read out of counter 5' from the take off time, or some other fixed time by a time interval corresponding to the number of counts which are inhibited during setting. The inhibited time interval is arranged to be somewhat longer than the longest expected rise time of the in-flight power, but no longer than necessary.

In a specific embodiment, oscillator 3' runs at 10 kHz while the scaler clocks the counter at 5 kHz (oscillator/2) during setting. The clocking interval is the fuze function time divided by 512. Under in-flight conditions, the oscillator runs at the identical 10 kHz but the scaler clocks the counter at about 10 Hz (oscillator/1024). Inhibit block 7 is effective to inhibit the line for a time interval corresponding to the first ten oscillator periods in the setting time interval. During in-flight operation, the line would be inhibited for a time interval 512 times longer than during setting.

Figure 3:
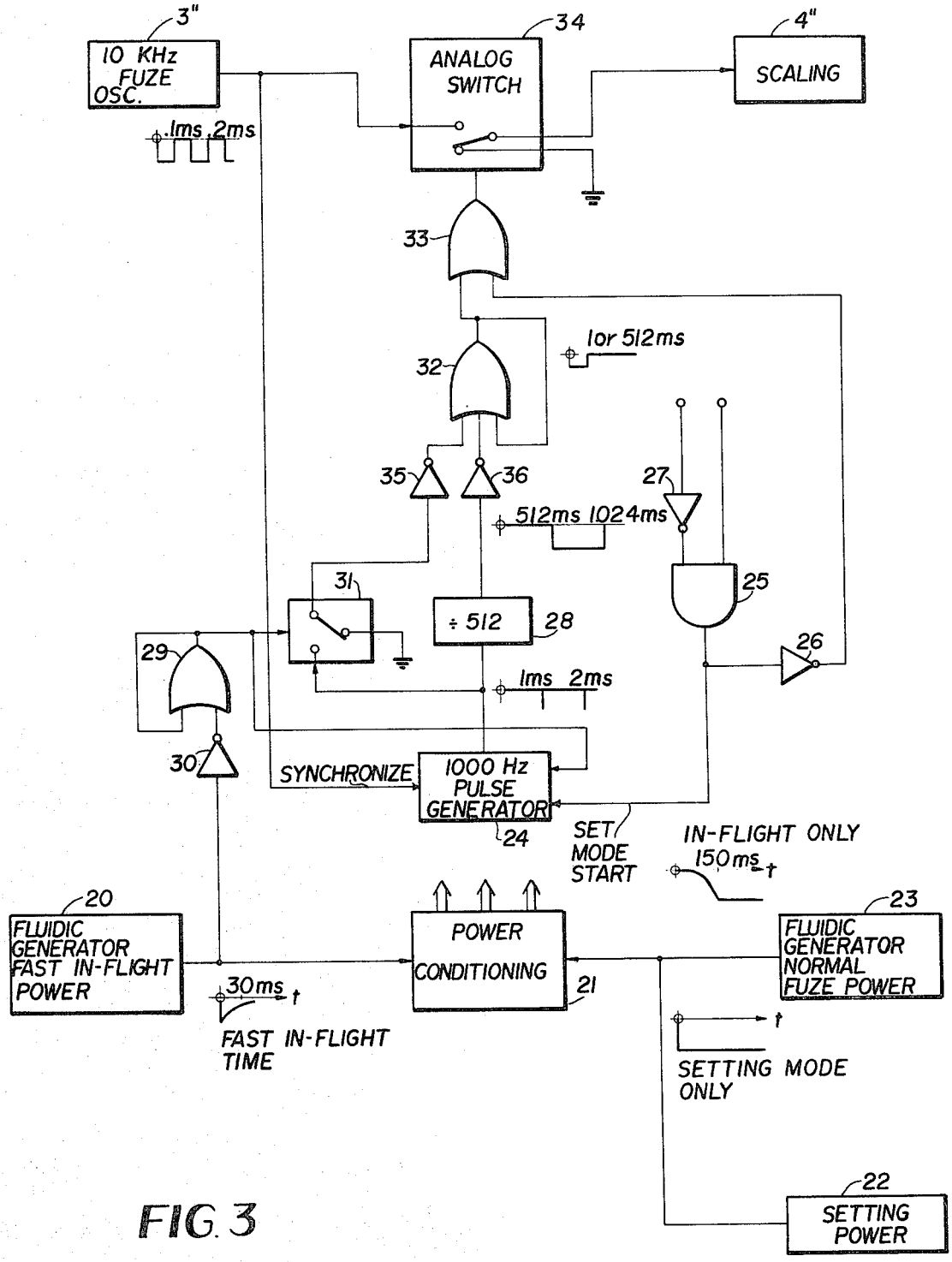
FIG. 3 is a more detailed diagram of an embodiment of the invention.

FIG. 3 is a specific circuit embodiment of the invention. Power during setting is provided by setting power block 22 and as mentioned above, the setting operation takes place while the missile is on the ground. At take-off shock excitation causes the fluidic generator to generate a power pulse, and this is referred to as Fast In-Flight Power at block 20. As seen by the timing diagram adjacent to block 20, the fast in-flight power disappears quickly, typically within 30 milliseconds. The Normal Fuze Power which is generated by the fluidic generator is represented at block 23, and is proportional to the velocity of the missile. It is the normal fuze in-flight power which provides the primary power to the timing system, and it is the variability of the rise time of this power which causes the problem which the invention is designed to obviate. As seen in FIG. 3, both the fast inflight power and the normal fuze power are inputted to power conditioning block 21. A main function of the power conditioning block is to capture the initially produced fast in-flight power and to stretch the period of time over which this power is applied to the system for substantially greater than the 30 milliseconds or so over which the initial pulse lasts. In this regard, the power conditioning block would typically include rectifier means, capacitor means, and voltage regulation circuitry, and the exact details of such a block are known to those skilled in the art.

To set the counter with the circuit shown in FIG. 3, setting power is applied from block 22, and at sometime after the application of such power, electronics including AND gate 25 but not otherwise disclosed in the present specification are arranged to generate a "set mode start" signal, which is inputted to 1000 Hz pulse generator 24. This pulse generator is synchronized with 10 kHz oscillator 3", and is arranged to generate a pulse on the negative going edge of the signal generated by the oscillator. When the missile is on the ground, the fluidic generator is not generating power, there is no output from block 20, and circuit elements 29 and 30 are arranged to control analog switch 31 so as to connect the output of the pulse generator with inverter 35. The output of the inverter is connected to an input of OR gate 32, the output of which is connected to an input of OR gate 33, the output of which is connected to analog switch 34. Signals flow through the circuitry such that analog switch 34 connects scaler 4" to ground, or in other words inhibits the pulses from oscillator 3", for one millisecond, after which the analog switch connects the oscillator to the scaler.

At missile take-off, fluidic generator fast real time power is generated and the state of the input to analog switch 31 changes, thus connecting the switch to ground, and causing the operative output of the pulse generator to be fed to divider 28 which divides the pulses fed thereto by 512. The output of the divider is in turn fed to an inverter 36, OR gate 32, OR gate 33, and analog switch 34. Thus, during in-flight operation the circuitry is effective to hold analog switch 34 to ground, or in other words to inhibit the oscillator pulses from reaching the scaler for 512 milliseconds. While positive logic using negative voltage levels is illustrated in the Figure, it should be understood that any other type of logic could be used.

Figure 4:
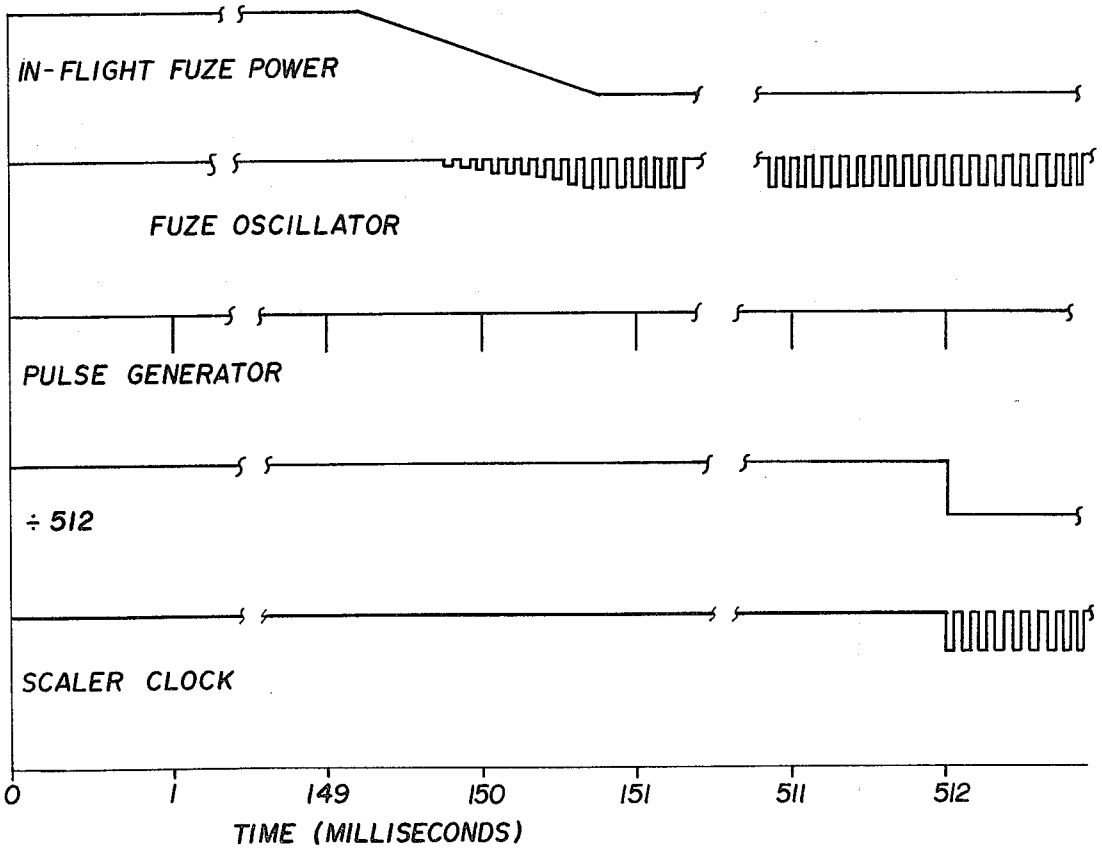
FIG. 4 is a graphical diagram depicting waveforms produced in the embodiment of FIG. 3.

A set of waveforms which illustrates the in-flight operation of the circuitry is shown in FIG. 4. It should be noted that since the pulse generator synchronizes to the oscillator signal when the oscillator signal is present, the first 150 or so pulses are not sychronized and may contribute some error to the system.

I wish it to be understood that I do not desire to be limited to the exact details of construction shown and described, for obvious modifications can be made by a person skilled in the art.

I claim:

1. An apparatus for eliminating variable power source rise time effects in a fuze timing system for providing a fuze trigger signal comprising:

a programmable timing means comprising a counter powered by said power source;

means for programming said timing means, including an oscillator or clock, with a setting time;

means for reading said setting time out of said timing means, said means for reading out also includes said oscillator and wherein said oscillator is run at different frequencies during programming and during reading out;

means for providing said fuze trigger signal upon completion of said setting time; means for reducing said setting time beneath the time in which it is desired for said fuze trigger signal to be provided by a fixed amount of time which is greater than the longest expectable rise time of said power source;

means for delaying the reading out of said setting time by said fixed amount of time, whereby said fuze trigger signal is provided at a time which is independent of power source rise time variations; and wherein said means for reducing and said means for delaying both include an inhibit means which is connected between said oscillator and said counter.

2. An apparatus, as recited in claim 1, wherein said inhibit means includes analog switches.

3. An apparatus, as recited in claim 2, wherein said power source comprises a fluidic generator.

* * * * *